US005398933A

United States Patent [19]

Thompson et al.

[11] Patent Number: 5,398,933

[45] Date of Patent: Mar. 21, 1995

[54] CARD GAME PARAMETER INDICATOR APPARATUS

[76] Inventors: Lyle M. Thompson; Joan E. Thompson, both of R.D. #3, Box 52, Richfield Springs, N.Y. 13439

[21] Appl. No.: 165,639

[22] Filed: Dec. 13, 1993

[51] Int. Cl.[6] ..... A63F 1/18

[52] U.S. Cl. ..... 273/148 R

[58] Field of Search ..... 273/148 R, 268

[56] References Cited

U.S. PATENT DOCUMENTS

| | | | |
|---|---|---|---|
| 280,375 | 7/1883 | Horton | 273/148 R X |
| 481,947 | 9/1892 | Hillard | 273/148 R X |
| 1,704,617 | 3/1929 | Littlefield | 273/148 R |
| 1,924,479 | 8/1933 | Balch | 273/148 R |
| 3,822,487 | 7/1974 | Koch . | |
| 4,421,315 | 12/1983 | Cutler | 273/148 R X |
| 4,508,347 | 4/1985 | Shettler . | |
| 4,950,165 | 8/1990 | Machaalani . | |
| 5,092,777 | 3/1992 | Crowe . | |
| 5,145,175 | 9/1992 | Gathman et al. . | |
| 5,158,294 | 10/1992 | Piro | 273/148 R |

FOREIGN PATENT DOCUMENTS

| | | | |
|---|---|---|---|
| 107964 | 3/1899 | Germany | 273/148 R |
| 444712 | 3/1926 | Germany | 273/148 R |
| 10973 | of 1900 | United Kingdom | 273/148 R |
| 395939 | 7/1933 | United Kingdom | 273/148 R |

*Primary Examiner*—William E. Stoll

[57] ABSTRACT

A game parameter indicator apparatus includes a base unit which includes a plurality of vertical walls, wherein two opposite vertical walls retain a shaft. The base unit includes a floor member connected between two opposite vertical walls, and the floor member includes a stop member positioned on the floor member such that respective ends of the display units are stopped in their rotation around the shaft when the display units are rotated to a vertical orientation in the in-effect display mode. The indicia relate to parameters in the card game pitch and include respective symbols for trump suits of hearts, clubs, diamonds, spades, and include respective symbols for a jack, a bid of two, a bid of three, and a bid of four.

4 Claims, 2 Drawing Sheets

CARD GAME PARAMETER INDICATOR APPARATUS

BACKGROUND OF THE INVENTION

1. Field of the Invention

The present invention relates generally to card games and, more particularly, to a device especially adapted for indicating the status of parameters that are important in the play of the card game.

2. Description of the Prior Art

In the play of some card games, e.g. pitch, it is important that the players be aware of certain game parameters such as the trump suit, whether a jack is played, and the point bid. However, during play, it is a common occurrence that players forget one or more the important parameters. When a player forgets an important parameter, one or more of the following results may occur.

The player may ask the other players the status of the forgotten parameter, but this may be annoying to the other players. In this respect, it would be desirable if a device were provided for a card game which precluded the necessity of a player asking other players as to the status of important game parameters.

The player may have forgotten an actual game parameter and may be thinking of an erroneous game parameter and play the game accordingly. Such erroneous play may mess up the smooth play of the game and lead to confusion among players who remember the correct game parameters. In this respect, it would be desirable if a device were provided for a card game which helps prevent a player from playing a game while keeping erroneous game parameters in mind.

When a player plays in accordance with erroneous game parameters, other players are often irritated, and such play may lead to disputes, accusations, and arguments. Such conflicts may erode friendships and cause a potentially enjoyable game experience to deteriorate into a unpleasant cause of controversy and anxiety. In this respect, it would be desirable if a device were provided for a card game which helped prevent disputes and arguments over forgotten game parameters.

Still other features would be desirable in an apparatus that helps prevent disputes from arising over card game parameters. It would be desirable if the apparatus were easy to operate. It would be desirable if the device had indicia that were easy for all the players to see. It would also be desirable for such a card game parameter apparatus to include a mechanism to prevent accidental display of erroneous parameters.

The use of indicia on support surfaces is a well known technique for educating and conveying useful information. For example, the following U.S. patents are representative of some devices which employ indicia on support surfaces: U.S. Pat. Nos. 3,822,487; 4,508,347; 4,950,165; 5,092,777; and 5,145,175. All of the above-cited patents relate to devices which include alphabet indicia for teaching the letters of the alphabet to children. None of the above-cited patents relate to devices for displaying parameters of a card game.

Thus, while the foregoing body of prior art indicates it to be well known to use devices bearing indicia for educational purposes, the prior art described above does not teach or suggest a card game parameter indicator apparatus which has the following combination of desirable features: (1) precludes the necessity of a player asking other players as to the status of important game parameters; (2) helps prevent a player from playing a game while keeping erroneous game parameters in mind; (3) helps prevent disputes and arguments over forgotten game parameters; (4) is easy to operate; (5) has indicia that are easy for all the players to see; and (6) includes a mechanism to prevent accidental display of erroneous parameters. The foregoing desired characteristics are provided by the unique card game parameter indicator apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved game parameter indicator apparatus which includes a base unit which includes a plurality of vertical walls, wherein two opposite vertical walls retain a shaft. The base unit includes a floor member connected between two opposite vertical walls, and the floor member includes a stop member positioned on the floor member such that respective ends of the display units are stopped in their rotation around the shaft when the display units are rotated to a vertical orientation in the in-effect display mode. The indicia relate to parameters in the card game pitch and include respective symbols for trump suits of hearts, clubs, diamonds, spades, and include respective symbols for a jack, a bid of two, a bid of three, and a bid of four. The floor member includes resilient feet attached to a bottom side of the floor member. When the display units are moved from a horizontal, non-display orientation to a vertical, display orientation, the main portions of the display units are raised from a lower to a higher position. In this respect, the force of gravity must be overcome to bring about the display orientation. This feature makes it difficult for a display unit to be accidentally or inadvertently moved from a non-display to a display orientation.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved card game parameter indicator apparatus which has all of the advantages of the prior art and none of the disadvantages.

It is another object of the present invention to provide a new and improved card game parameter indicator apparatus which may be easily and efficiently manufactured and marketed.

It is a further object of the present invention to provide a new and improved card game parameter indicator apparatus which is of durable and reliable construction.

An even further object of the present invention is to provide a new and improved card game parameter indicator apparatus which is susceptible of a low cost of manufacture with regard to both materials and labor, and which accordingly is then susceptible of low prices of sale to the consuming public, thereby making such card game parameter indicator apparatus available to the buying public.

Still yet a further object of the present invention is to provide a new and improved card game parameter indicator apparatus which precludes the necessity of a player asking other players as to the status of important game parameters.

Still another object of the present invention is to provide a new and improved card game parameter indicator apparatus that helps prevent a player from playing a game while keeping erroneous game parameters in mind.

Yet another object of the present invention is to provide a new and improved card game parameter indicator apparatus which helps prevent disputes and arguments over forgotten game parameters.

Even another object of the present invention is to provide a new and improved card game parameter indicator apparatus that is easy to operate.

Still a further object of the present invention is to provide a new and improved card game parameter indicator apparatus which has indicia that are easy for all the players to see.

Yet another object of the present invention is to provide a new and improved card game parameter indicator apparatus that includes a mechanism to prevent accidental display of erroneous parameters.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
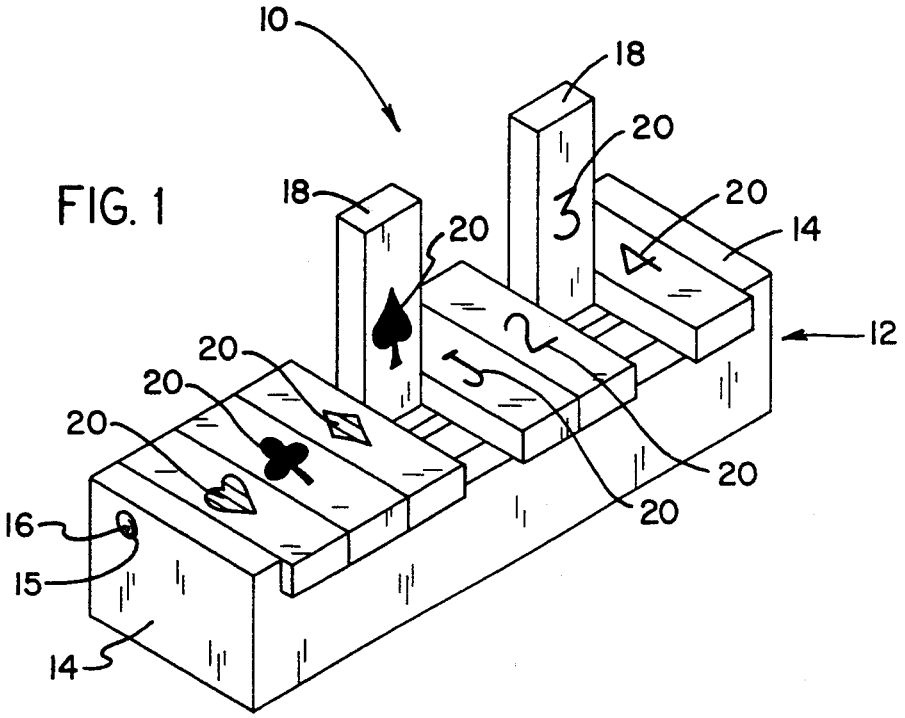
FIG. 1 is a perspective view showing a preferred embodiment of the card game parameter indicator apparatus of the invention indicating that the trump is spades and the bid is three.
Figure 2:
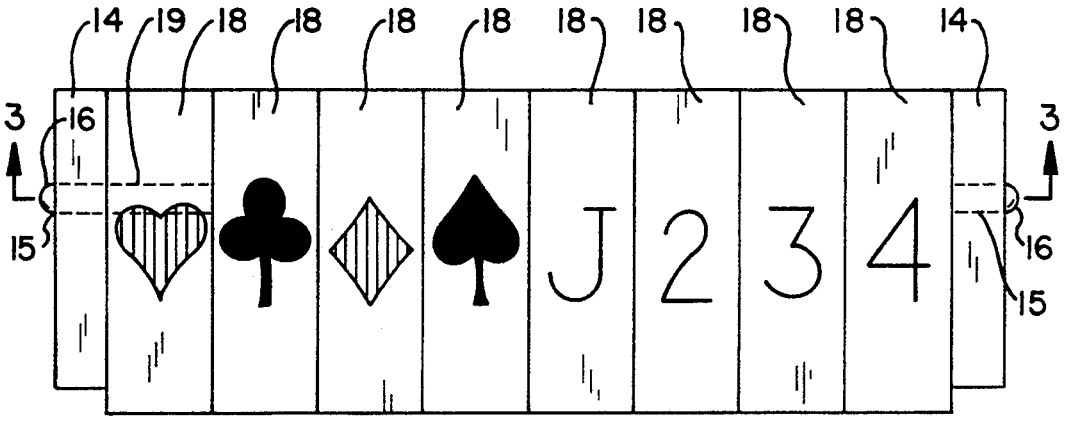
FIG. 2 is an enlarged top view of the embodiment of the invention shown in FIG. 1 wherein all of the indicators are in a non-indicating position.
Figure 3:
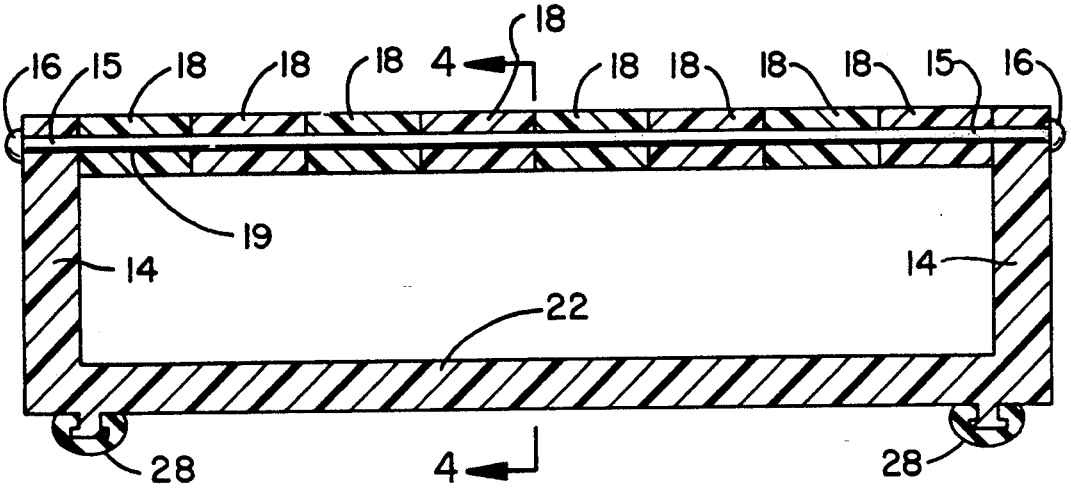
FIG. 3 is a cross-sectional view of the card game parameter indicator apparatus of FIG. 2 taken along line 3—3 thereof.

With reference to the drawings, a new and improved card game parameter indicator apparatus embodying the principles and concepts of the present invention will be described.

Turning to FIGS. 1–4, there is shown an exemplary embodiment of the card game parameter indicator apparatus of the invention generally designated by reference numeral 10. In its preferred form, card game parameter indicator apparatus 10 includes a base unit 12 which includes a plurality of vertical walls 14, wherein two opposite vertical walls 14 retain a shaft 16. Channels 15 in the vertical walls 14 retain the shaft 16 in the opposite vertical walls 14. A plurality of indicia-bearing, rotatable, display units 18 are supported by the shaft 16 such that the display units 18 are capable of being selectively oriented in an in-effect display mode or an inactive mode. The display units 18 are manually rotatable on the shaft 16 to a vertical orientation in the in-effect display mode, and the display units 18 are manually rotatable on the shaft 16 to a horizontal orientation in the inactive mode. The display units 18 include indicia 20 which relate to parameters in a game, such as a card game, such as pitch. Each display unit 18 includes a shaft-receiving channel 19 through which the shaft 16 passes and on which the display unit 18 rotates around the shaft 16.

Figure 4:
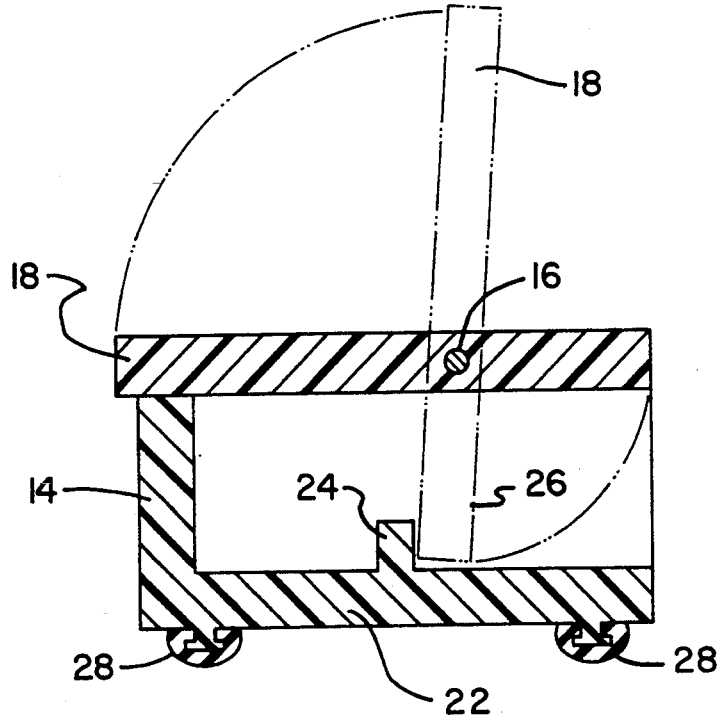
FIG. 4 is a cross-sectional view of the embodiment of the invention shown in FIG. 3 taken along line 4—4 thereof.

The base unit 12 includes a floor member 22 connected between two opposite vertical walls 14, and the floor member 22 includes a stop member 24 positioned on the floor member 22 such that respective ends 26 of the display units 18 are stopped in their rotation around the shaft 16 when the display units 18 are rotated to a vertical orientation in the in-effect display mode. As shown in FIG. 4 in solid lines, the display unit 18 is in the inactive mode in horizontal orientation. In addition, as shown in dashed lines, the same display unit 18 is rotated around the shaft 16 to a vertical orientation for the in-effect display mode. The end 26 of the display unit 18 butts up against the stop member 24 to limit the rotation of the display unit 18 and to maintain the display unit 18 in the vertical orientation.

As shown in the figures, the indicia 20 relate to parameters in the card game pitch and include respective symbols for trump suits of hearts, clubs, diamonds, spades, and include respective symbols for a jack, a bid of two, a bid of three, and a bid of four. As shown in FIG. 1, the parameters indicated which are in the in-effect display mode and vertically oriented are the trump suit of spades and the bid of three. The parameters which are in the inactive mode and horizontally oriented are the suits of hearts, clubs, and diamonds, the jack display unit, and the bid display units for two and four.

For the embodiment of the invention shown in FIGS. 1–4, to rotate the respective display units 18 around the shaft 16, each display unit 18 is grasped manually and rotated around the shaft 16. The floor member 22 includes resilient rubber feet 28 attached to a bottom side of the floor member 22.

The components of the card game parameter indicator apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved card game parameter indicator apparatus that is low in cost, relatively simple in design and operation, and which may advantageously be used to preclude the necessity of a player asking other players as to the status of important game parameters. With the invention, a card game parameter indicator apparatus is provided which helps prevent a player from playing a game while keeping erroneous game parameters in mind. With the invention, a card game parameter indicator apparatus is provided which helps prevent disputes and arguments over forgotten game parameters. With the invention, a card game parameter indicator apparatus is provided which is easy to operate. With the invention, a card game parameter indicator apparatus is provided which has indicia that are easy for all the players to see. With the invention, a card game parameter indicator apparatus is provided which includes a mechanism to prevent accidental display of erroneous parameters.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A card game parameter indicator apparatus for indicating one or more parameters in a card game which employs cards having suits of hearts, clubs, diamonds, and spades and has jacks, comprising:

a base unit which includes a plurality of vertical walls, wherein two opposite vertical walls include means for retaining a shaft, a shaft supported by said shaft retaining means on said opposite vertical walls, and a plurality of indicia-bearing, rotatable, display units supported by said shaft such that said display units are capable of being selectively oriented in an in-effect display mode or an inactive mode, wherein said display units are rotatable on said shaft to a vertical orientation in said in-effect display mode, and said display units are rotatable on said shaft to a horizontal orientation in said inactive mode, said display units including indicia which relate to parameters in the card game, wherein said base unit includes a floor member connected between two opposite vertical walls, and wherein said floor member includes a stop member positioned on said floor member such that respective bottom ends of said display units are stopped in their rotation around said shaft by contacting said stop member when said display units are rotated to a vertical orientation in said in-effect display mode.

2. The apparatus described in claim 1 wherein the card game is pitch.

3. The apparatus described in claim 1 wherein said floor member includes resilient feet attached to a bottom side of said floor member.

4. A game parameter indicator apparatus for indicating one or more parameters in a card game which employs cards having suits of hearts, clubs, diamonds, and spades and has jacks, comprising:

a base unit which includes a plurality of vertical walls, wherein two opposite vertical walls include means for retaining a shaft, a shaft supported by said shaft retaining means on said opposite vertical walls, and a plurality of indicia-bearing, rotatable, display units supported by said shaft such that said display units are capable of being selectively oriented in an in-effect display mode or an inactive mode, wherein said display units are rotatable on said shaft to a vertical orientation in said in-effect display mode, and said display units are rotatable on said shaft to a horizontal orientation in said inactive mode, said display units including indicia which relate to parameters in the card game, wherein said indicia relate to parameters in the card game pitch, and wherein said indicia consist essentially of respective symbols for trump suits of hearts, clubs, diamonds, and spades, and respective symbols for a jack, a bid of two, a bid of three, and a bid of four such that the game of pitch may be bid.

* * * * *